United States Patent [19]

Claesson et al.

[11] 3,938,361

[45] Feb. 17, 1976

[54] PRESS CONTAINING A PRESSURE CELL WITH A FLEXIBLE DIAPHRAGM AND A FORMING PAD INFLUENCED BY SAID DIAPHRAGM

[75] Inventors: Harry Claesson; Anders Traff, both of Vasteras, Sweden

[73] Assignee: Allmanna Svenska Elektriska Aktiebolaget, Vasteras, Sweden

[22] Filed: Dec. 5, 1974

[21] Appl. No.: 529,892

[30] Foreign Application Priority Data

Dec. 6, 1973 Sweden ..... 7316456

[52] U.S. Cl. ..... 72/63; 92/102

[51] Int. Cl.[2] ..... B21D 22/12

[58] Field of Search ..... 72/63, 453; 92/92, 98, 92/102; 100/211, 212

[56] References Cited

UNITED STATES PATENTS

| | | | |
|---|---|---|---|
| 2,669,209 | 2/1954 | Hoffman | 72/63 |
| 2,771,850 | 11/1956 | Wheelon | 72/63 |
| 2,786,423 | 11/1956 | Coffey | 92/102 |
| 3,093,086 | 6/1963 | Alotz et al. | 92/102 X |
| 3,336,843 | 8/1967 | Griswold | 92/102 X |
| 3,645,139 | 2/1972 | Zauoda | 92/102 X |

*Primary Examiner*—Lowell A. Larson

[57] ABSTRACT

In a hydraulic press which includes a pressure cell with a diaphragm of flexible material which is intended to press a pad of flexible material against forming pieces in a working space below the pad, the diaphragm has an opening with an annular bead therearound. Two disc-like attachment members are provided, which form between them an annular groove which fits the bead of the diaphragm. Between the bead and one of the attachment members there is formed an annular groove within which is a sealing ring which engages between the bead and at least one of the annular members.

2 Claims, 4 Drawing Figures

Fig. 1
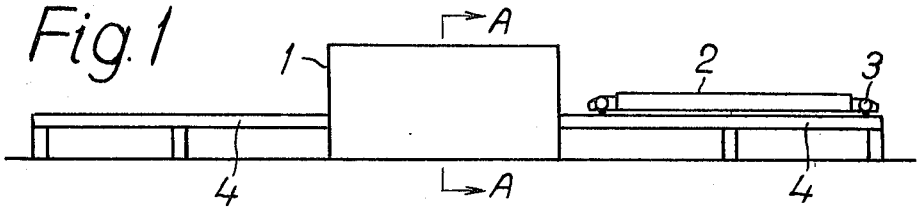
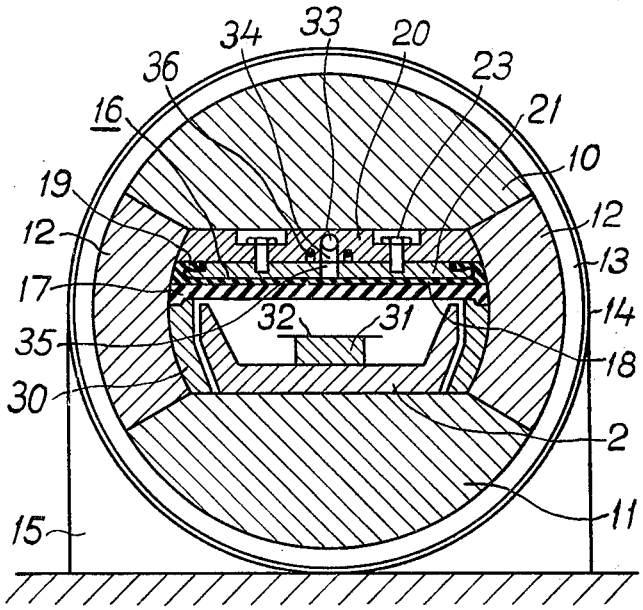
Fig. 2
Fig. 3
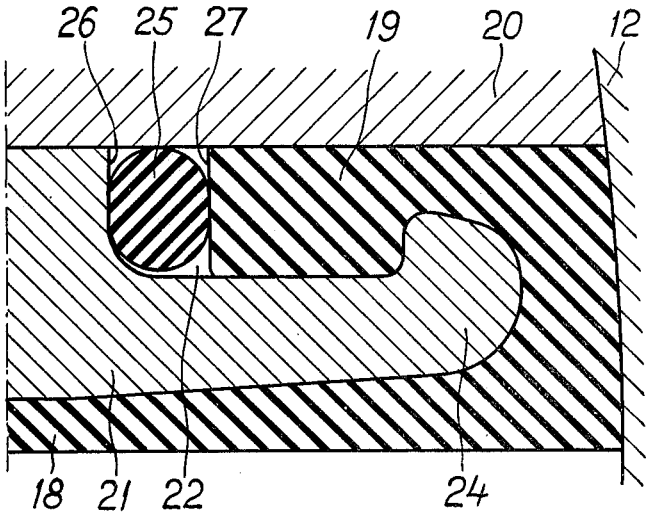
Fig. 4
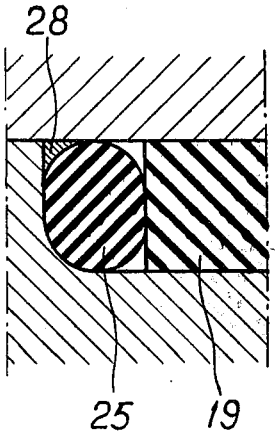

PRESS CONTAINING A PRESSURE CELL WITH A FLEXIBLE DIAPHRAGM AND A FORMING PAD INFLUENCED BY SAID DIAPHRAGM

RELATED APPLICATIONS

An application of Pertti Syvakari Ser. No. 529,891, filed Dec. 5, 1974 corresponding to Swedish application no. 7407992-2, filed June 18, 1974, KN4728U, discloses an improvement on the present device, which however was invented by a different inventor.

BACKGROUND OF THE INVENTION

1. Field of the Invention

The present invention relates to a hydraulic press of the type containing a pressure cell with a diaphragm of flexible material and a pad, influenced by said diaphragm, which is also of a flexible material, said press pressing workpieces against a tool and giving them the desired shape. A press of this kind has normally a very large working surface and is used, for example, in the manufacture of sheet-metal parts in the aviation industry, for example ribs and beams of various kinds.

2. The Prior Art

A press according to the invention comprises a press stand with a working space with a substantially rectangular cross-section. In this the pressure cell and the pad are normally suspended from the roof of the working space. Workpieces are placed on tools on a trough-shaped carrying member, which together with the workpieces is pushed into the working space of the press so that it will be located below the pressure cell and the forming pad. The pressure cell contains a bag-like diaphragm which is shaped with an annular bead around the opening. The diaphragm is clamped between two disc-shaped attachment members, one of these being located inside the bag-like diaphragm. The discs form an annular groove adjusted to the bead, which groove fixes the position of the diaphragm. The cavity in the pressure cell is thus defined by the inner surface of the diaphragm and of the inner surface of the disc which is located inside the bag-like diaphragm. The connection between the diaphragm bead and the inner disc-shaped attachment member must be made so that a perfect seal is obtained. The bead has usually been glued or vulcanized onto the inner attachment member and clamped between the two attachment members which form the groove for the bead, but it has been found that pressure medium tends to leak out between the bead and the inner attachment member. The difficulties in obtaining sealing have increased when the working pressure increases. Today the working pressure in modern presses is of the order of magnitude of 1000 bar, but users desire presses which permit higher working pressures.

SUMMARY OF THE INVENTION

According to the invention the sealing between the diaphragm and the attachment members is improved by the fact that these three units form a second annular groove and that at least one sealing ring of resilient material is arranged in said groove. The bead and one attachment member may form side surfaces in said second groove. The sealing ring, which may be an O-ring, makes contact with these sides in a sealing manner and prevents pressure medium from penetrating in between the bead of the diaphragm and one attachment member and between the two attachment members, respectively. In some cases it may be convenient to use also a metallic support ring having, for example, a triangular cross-section, said support ring bridging a gap between the attachment members of the diaphragm and preventing the sealing ring from being pressed out in a gap between these.

BRIEF DESCRIPTION OF THE DRAWINGS

The invention will be described more fully with reference to the accompanying drawings.

FIG. 1 shows a side view of a press plant,

FIG. 2 a section through the press at A — A in FIG. 1,

FIGS. 3 and 4 the attachment of the diaphragm.

DESCRIPTION OF THE PREFERRED EMBODIMENTS

In the figures, 1 designates a press and 2 a trough-shaped carrying member onto which workpieces and tools are placed. The carrying member is provided with transport rollers 3 running on tracks 4. The carrying member is displaceably arranged between the position shown in FIG. 1 where pressed plates are removed and new plates are put on the forming pieces, and a position inside the press below the pressure cell and the pressure pad which form the plates. The press shown is of the kind having a press stand which is built up of an upper yoke 10, a lower yoke 11 and two intermediate spacers 12, which are held together by a pre-stressed strip sheath 13. This is surrounded by a protective plate 14. The press rests on a support 15 having bearing plate beds adjusted to the press stand. Yokes and spacers form a working space with a substantially rectangular cross-section. At the upper part of this a pressure cell 16 and a pressure pad 17 are arranged. The pressure cell is built up of a bag-like diaphragm 18 having an annular bead 19, an upper disc 20 and a lower disc 21, forming a groove 22 fitting to the bead. The discs 20 and 21 are held together by bolts 23, the bead 19 thus being clamped between the groove-forming part 24 of the disc 21 and the plane under-surface of the upper disc 20.

In the embodiment according to FIGS. 3 and 4 the bead 19 has a smaller horizontal extension than the groove 22 formed by the attachment disc 20 and 21, so that in the interior part of the groove 22 a second annular groove is formed which is defined by the attachment discs 20 and 21 and by the inner vertical limiting surface 27 of the bead 19. In this groove there is a sealing ring 25 of resilient material and with such a cross-section that it is clamped between the vertical side surfaces 26 and 27 of the groove, thus sealingly bearing against them. The sealing ring 25 prevents pressure medium which may leak out between the outer part 24 of the disc 21 and the bead 19, from penetrating out between the bead 19 and the disc 20 and in between the discs 20 and 21, respectively.

In the embodiment according to FIG. 4 there is a metallic support ring 28 intended to prevent the sealing ring 25 from being pressed into any possible gap between the discs 20 and 21.

At the sides of the working space there are support members 30. In the trough-shaped carrying member 2 there is shown a forming tool 31. On this rests a plate 32 which is to be formed, by providing pressure medium in the pressure cell which presses the diaphragm 18 and the pad 17 with great force against the plate. Pressure medium is supplied to the pressure cell through the horizontal channel 33 in the disc 20 and the holes 34 and 35 in the discs 20 and 21. A seal 36 prevents pressure medium from penetrating in between the discs 20 and 21.

We claim:

1. Hydraulic press comprising a pressure cell with a diaphragm (18) of flexible material having an opening and an inwardly directed annular bead (19) around the opening, two disc-shaped attachment members (20,21) for the diaphragm which form between them a first annular groove fitting to the bead, and a pad of flexible material influenced by the pressure cell for forming plates which are placed on forming pieces in a working space below the pad, said two attachment members and the bead of the diaphragm together forming a second closed annular groove and at least one sealing ring (25) of elastic material arranged in said second groove.

2. Hydraulic press according to claim 1, in which one attachment member and the bead form side and bottom surfaces in the second annular groove and the sealing ring makes contact with said side surfaces.

* * * * *